US008022909B2

(12) United States Patent
Shuford

(10) Patent No.: US 8,022,909 B2
(45) Date of Patent: Sep. 20, 2011

(54) SYSTEM, METHOD, AND APPARATUS FOR GENERATING GRAYSCALES IN AN LCD PANEL

(75) Inventor: Clark Shuford, Rochester, MN (US)

(73) Assignee: Via Technologies, Inc., Taipei (TW)

( * ) Notice: Subject to any disclaimer, the term of this patent is extended or adjusted under 35 U.S.C. 154(b) by 1674 days.

(21) Appl. No.: 11/008,071

(22) Filed: Dec. 8, 2004

(65) Prior Publication Data

US 2006/0119558 A1 Jun. 8, 2006

(51) Int. Cl.
*G09G 3/36* (2006.01)

(52) U.S. Cl. ..... 345/89

(58) Field of Classification Search ..... 345/89, 345/204, 596, 690, 691–696
See application file for complete search history.

(56) References Cited

U.S. PATENT DOCUMENTS

| | | | | |
|---|---|---|---|---|
| 4,342,990 | A * | 8/1982 | Traster | 345/471 |
| 5,196,839 | A * | 3/1993 | Johary et al. | 345/691 |
| 5,293,159 | A * | 3/1994 | Bassetti et al. | 345/691 |
| 5,389,948 | A * | 2/1995 | Liu | 345/691 |
| 5,534,883 | A * | 7/1996 | Koh | 345/3.2 |
| 5,714,974 | A * | 2/1998 | Liu | 345/694 |
| 5,777,590 | A * | 7/1998 | Saxena et al. | 345/89 |
| 5,892,496 | A * | 4/1999 | Wakeland | 345/694 |
| 6,069,609 | A * | 5/2000 | Ishida et al. | 345/596 |
| 6,121,952 | A | 9/2000 | Igari | |
| 6,175,355 | B1 * | 1/2001 | Reddy | 345/691 |
| 6,198,469 | B1 * | 3/2001 | Tjandrasuwita | 345/690 |
| 6,219,838 | B1 | 4/2001 | Cherichetti et al. | |
| 6,288,698 | B1 * | 9/2001 | Ishii et al. | 345/87 |
| 6,449,061 | B2 * | 9/2002 | Metcalfe | 358/3.05 |
| 6,734,866 | B1 * | 5/2004 | Dotson | 345/546 |
| 6,795,085 | B1 | 9/2004 | Doherty et al. | |
| 6,864,870 | B2 * | 3/2005 | Kim et al. | 345/89 |
| 2001/0028346 | A1 * | 10/2001 | Kudo et al. | 345/204 |
| 2005/0110796 | A1 * | 5/2005 | Flowers et al. | 345/589 |

OTHER PUBLICATIONS

"Geode CS9211 Graphics Companion Flat Panel Disply Controller;"National Semiconductor Corporation; Oct. 2000; pp. 1-62.

* cited by examiner

*Primary Examiner* — Ke Xiao
*Assistant Examiner* — Rodney Amadiz
(74) *Attorney, Agent, or Firm* — Thomas, Kayden, Horstemeyer & Risley, LLP

(57) ABSTRACT

Discussed herein is a circuit for generating grayscales in a display. The circuit generally comprises grayscale values, one of which is a present grayscale value. Also included is at least one grayscale pattern, comprising at least one pattern bit and corresponding to each of the grayscale values. The circuit may comprise at least one programmable register configured to store at least one grayscale pattern, and a first row multiplexor corresponding to the number of grayscale values, the first row multiplexor configured to receive a pattern bit from each grayscale pattern. The first row multiplexor may also be collectively configured to select a desired grayscale pattern, determined from the present grayscale value. The pixel select circuit is generally configured to determine a desired pattern bit. Finally, a second row multiplexor is coupled to the first row multiplexor and configured to select the desired pattern bit.

24 Claims, 11 Drawing Sheets

| 10 GRAYSCALE | FRACTION OF FRAMES THAT PIXELS ARE ON |
|---|---|
| 0 | 0/16 |
| 1 | 1/16 |
| 2 | 2/16 |
| 3 | 3/16 |
| 4 | 4/16 |
| 5 | 5/16 |
| 6 | 6/16 |
| 7 | 7/16 |
| 8 | 8/16 |
| 9 | 9/16 |
| 10 | 10/16 |
| 11 | 11/16 |
| 12 | 12/16 |
| 13 | 13/16 |
| 14 | 14/16 |
| 15 | 15/16 |

FIG. 1

| 30 GRAYSCALE | FRACTION OF FRAMES THAT PIXELS ARE ON |
|---|---|
| 0 | 0/32 |
| 1 | 4/32 |
| 2 | 8/32 |
| 3 | 11/32 |
| 4 | 14/32 |
| 5 | 17/32 |
| 6 | 19/32 |
| 7 | 21/32 |
| 8 | 23/32 |
| 9 | 25/32 |
| 10 | 26/32 |
| 11 | 27/32 |
| 12 | 28/32 |
| 13 | 29/32 |
| 14 | 30/32 |
| 15 | 31/32 |

FIG. 3

| 40<br>GRAYSCALE | DEFAULT PATTERN |
|---|---|
| 0 | 00000000000000000000000000000000 |
| 1 | 10000000000000000000000000000000 |
| 2 | 11000000000000000000000000000000 |
| 3 | 11100000000000000000000000000000 |
| 4 | 11110000000000000000000000000000 |
| 5 | 11111000000000000000000000000000 |
| 6 | 11111100000000000000000000000000 |
| 7 | 11111110000000000000000000000000 |
| 8 | 11111111000000000000000000000000 |
| 9 | 11111111100000000000000000000000 |
| 10 | 11111111110000000000000000000000 |
| 11 | 11111111111000000000000000000000 |
| 12 | 11111111111100000000000000000000 |
| 13 | 11111111111110000000000000000000 |
| 14 | 11111111111111000000000000000000 |
| 15 | 11111111111111100000000000000000 |

FIG. 4

| 50 GRAYSCALE | PROGRAMMED PATTERN |
|---|---|
| 0 | 00000000000000000000000000000000 |
| 1 | 00000000000000010000000000000000 |
| 2 | 00000000001000000000000000000001 |
| 3 | 00000000100000000010000000000001 |
| 4 | 00000001000000010000000100000001 |
| 5 | 00000010000000100000010000000010001 |
| 6 | 00000100001000010000100000100001 |
| 7 | 10000100001000010000100000100001 |
| 8 | 10001000100010001000100010001000 |
| 9 | 10001000100010001000100010001001 |
| 10 | 10010010010010010010010010010000 |
| 11 | 10010010010010010010010010010010 |
| 12 | 10101000101010100010100010001010 |
| 13 | 10010100101001010010100101001010 |
| 14 | 10101001010010100101001010010100 |
| 15 | 00101010101010101010101010101010 |

FIG. 5

| 60<br>GRAYSCALE | PROGRAMMED PATTERN |
|---|---|
| 0 | 00000000000000000000000000000000 |
| 1 | 10000000100000001000000000010000 |
| 2 | 10000010001000001000000100101001 |
| 3 | 10010010100100010010010001000101 |
| 4 | 10101001010010100101001010010100 |
| 5 | 11101010101010101010101010101010 |
| 6 | 11101010101010101011101010101110 |
| 7 | 11101110101110101110101110101010 |
| 8 | 11101011010101011101110111011111 |
| 9 | 11101111011110101110111011101111 |
| 10 | 11111011110111011111110111010111 |
| 11 | 11111011110111111111110111010111 |
| 12 | 11111011111111111111110111010111 |
| 13 | 11111111110111111111110111011111 |
| 14 | 11111111111111011111111111011111 |
| 15 | 11111111111111011111111111111111 |

FIG. 6

SYSTEM, METHOD, AND APPARATUS FOR GENERATING GRAYSCALES IN AN LCD PANEL

TECHNICAL FIELD

This disclosure relates to generating grayscales on a Liquid Crystal Display (LCD) panel. More specifically, this disclosure relates to generating grayscales on Super-Twist Nematic (STN) LCD panel by using programmable registers.

BACKGROUND

STN LCD panels are composed of many pixels that can either be on or off at any given time. The panel is made up of x number of pixels per line, and have y number of lines per panel. Updating all the pixels on all the lines of a panel constitutes one frame of data. Since each pixel for an STN panel has two states (on and off), each pixel is able to achieve two grayscale values, black and white. To achieve more (perceived) grayscale values, the pixels can turn on and off at a very high rate. Because the human eye is unable to detect this high rate of switching, the resulting grayscale value is somewhere between black and white, thereby giving it an apparent or perceived grayscale value.

One consequence associated with this high rate of switching is known as flickering. Flickering is a phenomenon that results in the human eye perceiving that the panel display is pulsating when the display should be uniform. This phenomenon can be distracting and undesirable.

There are various types of flickering in LCD panels (e.g., single pixel flickering and adjacent pixel flickering). Single pixel flickering can occur if the on/off time has a low frequency. Adjacent pixel flickering can occur when pixels in the same proximity are controlled according to identical schedules. However, when single pixel flickering occurs, those pixels with detectable switching appear to pulsate. When adjacent pixel flickering occurs, areas of the panel appear to pulsate.

The idea of grayscale shading with STN LCD panels is based on the principle that if power to a pixel is oscillated fast enough, the human eye will be unable to perceive the oscillation, and the person will only see the intended shade. One method of applying this theory is to divide a time segment into, for example, 16 parts. To achieve a particular shade, the pixel may be turned on for a predetermined fraction of the time segment.

As a nonlimiting example, if the desired shade of a pixel at a particular point in time is one half of full power, the desired shade value could be assigned a value of 8. If there are 16 possible grayscale values (i.e., the time segment was broken up into 16 parts), then the corresponding denotation is $8/16$. To achieve this shade, the pixel may be held on for the first 8 counts, and held off for the last 8 counts.

With respect to single pixel flicker, the problem results when a pixel's state is held for a duration such that the switching is detectable by the human eye. Referring to the previous nonlimiting example, holding a pixel in one state for 8 counts may enable a person to perceive when the pixel switches states. If this occurs, the pixel will appear to pulsate. Of course, pulsating effect can be reduced, by turning the pixel on and off every other count.

Adjacent pixel flickering is a phenomenon that results when multiple pixels on a display are oscillated according to identical schedules within the given time segment. In keeping with the previous example, suppose a pixel were turned on for 8 (out of 16) counts, and it was turned on and off with every other count, such an approach would avoid single-pixel flicker, but if all pixels were turned on and off at the same count, then adjacent pixel flickering could be observed.

Another phenomenon that should be taken into account when designing an STN LCD panel is that the human eye detects brightness in a nonlinear fashion. Thus, a small change in brightness at a dark grayscale is less noticeable than equal change in brightness at a bright grayscale. Therefore, designing an STN LCD panel with a linear shade distribution is less than effective in portraying all possible shades to the observer.

In designing an STN LCD panel, a frame rate control block (FRC) is often desired. A simple method for designing an FRC is to have a frame counter that counts from 0 to 15 and then restarts. The decision to turn one pixel on at a given frame may be based on the simple pseudo-code:

```
If (data[3:0] >= counter), then output = 1, else output =0
where "data [3:0]" is the grayscale value and "counter" is
the current value in the frame counter.
```

This technique is oftentimes too simplistic and may cause single pixel flicker as well as adjacent pixel flicker.

Accordingly, there is a heretofore unaddressed need to overcome the aforementioned deficiencies and shortcomings.

SUMMARY

Included herein is a circuit for generating grayscales in a display. The circuit may include a plurality of grayscale values, one of the grayscale values being a present grayscale value, and at least one grayscale pattern, each grayscale pattern including at least one pattern bit and each grayscale pattern corresponding to each of the grayscale values. Also included in the circuit is a programmable register configured to store at least one grayscale pattern, and a first row multiplexor corresponding to the plurality of grayscale values, the first row multiplexor configured to receive a pattern bit from each grayscale pattern. The first row multiplexor may also be configured to select a desired grayscale pattern, determined from the present grayscale value. A pixel select circuit may also be included and configured to determine a desired pattern bit. Finally, a second row multiplexor coupled to the first row multiplexor and configured to select the desired pattern bit.

BRIEF DESCRIPTION OF THE DRAWINGS

The components in the drawings are not necessarily to scale relative to each other. Like reference numerals designate corresponding parts throughout the several views.

FIG. 1 is a diagram illustrating a plurality of grayscale values and the corresponding time fraction to achieve a particular grayscale.

FIG. 3 is a flowchart diagram illustrating steps performed within the controller of FIG. 2.

FIG. 4 is a diagram representing one embodiment of a pixel power schedule within the controller of FIG. 2.

FIG. 5 is a diagram of one embodiment of a pixel power schedule utilizing patterns to eliminate single pixel flicker in an LCD panel of FIG. 2.

FIG. 6 is a diagram of one embodiment of a pixel power schedule utilizing patterns to eliminate flicker and nonlinear effects in an LCD panel of FIG. 2.

DETAILED DESCRIPTION

Figure 2:
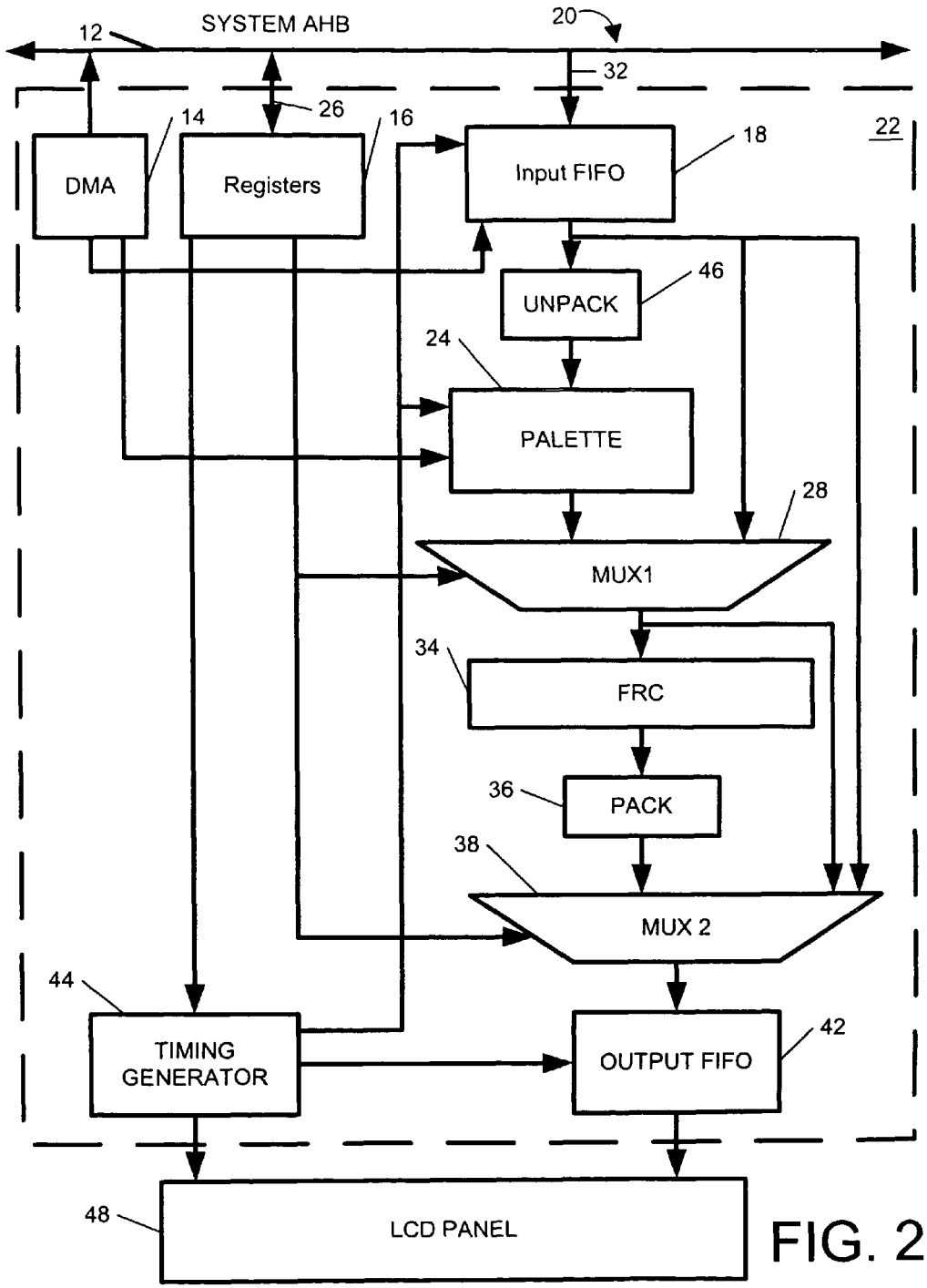
FIG. 2 is a functional block diagram of one embodiment of an LCD controller for generating the grayscale values from FIG. 1.

It should be emphasized that many variations and modifications may be made to the above-described embodiments. All such modifications and variations are intended to be included herein within the scope of this disclosure and protected by the following claims.

One method of solving adjacent pixel flicker is to introduce two linear feedback shift registers (LFSR) into the LCD controller.

An LFSR has two main parts, the shift register and the feedback function. A shift register is a device whose identifying function is to shift its contents into adjacent positions within the register or out of the register. The position on the other end is left empty unless some new content is shifted into the register. In the feedback function, the bits contained in selected positions in the shift register are combined in some sort of function and the result is communicated back into the register's input bit. By definition, the selected bit values are collected before the register is clocked and the result of the feedback function is inserted into the shift register during the shift, filling the position that is emptied as a result of the shift.

The first LFSR increments based upon the current pixel to reduce adjacent pixel flicker on the same row. The second LFSR increments for each new row to eliminate adjacent pixel flicker between pixels in the same column. The pseudocode now looks like:

```
If (data[3:0]>=(row_lfsr+column_lfsr) then output=1 else
    output=0.
```

Where "data [3:0]" is the grayscale value, "row_lfsr" is the value output from the row LFSR, and "column_lfsr" is the value output from the column LFSR.

While this technique eliminates adjacent pixel flicker, it does not eliminate single pixel flicker because the LFSR may cause a pixel to be on for many clock cycles in a row instead of evenly distributing them over the total number of frames used for the FRC algorithm. Another problem with this technique is that it does not account for the nonlinear detection of brightness levels by the human eye because all the grayscale levels have an equal increase in the total number of frames that they are "on" (i.e., each grayscale value is larger than the previous grayscale value by the same amount. This fixed algorithm also does not account for different panel characteristics amongst varying panel manufacturers.

A programmable register set is used in an STN LCD panel where each grayscale value has a pattern of on/off values associated with it. Separate row and column linear feedback shift registers (LFSRs) are added with a frame counter to select a single bit from the pattern. The row and column LFSRs reset at the beginning of each new frame of data, and the frame counter increments by 1 for each new frame. The LFSRs are used to "randomly" select a starting position for each pixel, while the incrementing frame counter allows the pixel to proceed through the pattern in a linear fashion. The patterns, on the other hand, address the single pixel flicker by carefully selecting the grayscale patterns to have a better distribution of on/off time when the single pixel flicker is addressed.

To address the non-linear brightness detection, the sixteen grayscale values are generated over 32 frames. By selecting the grayscale patterns over a 32 frame period, larger percentage increases in brightens can occur at dark grayscales while very small increases in brightness can occur at light grayscales. The programmable aspect of these registers allows different panel manufacturers to adjust these patterns slightly to best fit the characteristics of an associated panel.

FIG. 1 is a diagram illustrating a plurality of grayscale values and the corresponding time fraction to achieve a particular grayscale. As shown in Table 10 of FIG. 1, one method of producing different grayscales in an LCD display is to create 16 values that correspond with 16 different time fractions. As shown in this nonlimiting example, if a grayscale of 2 is desired, the corresponding pixels are held in the "on" position for the first two of 16 counts. More specifically, if a time base of 16 microseconds is designated, then each division of the time base equals 16 microseconds/16 counts equals one microsecond per count. This means that if a grayscale of 2 is desired, the corresponding pixels are held in the "on" position for the first two microseconds of the 16 microsecond cycle, and held "off" for the last 14 microseconds of the 16 microsecond cycle.

As will be appreciated by one of ordinary skill in the art, this example is merely an illustration of grayscale division. A time division with a time base of one microsecond is merely included for mathematical simplicity, and is not intended to indicate an appropriate or desired time frame.

FIG. 2 is a functional block diagram of one embodiment of an LCD controller 20 for generating the grayscale values from FIG. 1. As generally shown in FIG. 2, system AHB (Advanced High-performance Bus) 12 couples to LCD module 22 via AHB slave interface 26, AHB master interface 32, and DMA (Direct Memory Access) module 14. AHB slave interface 26 is coupled to registers 16, while AHB master interface 32 is coupled to input FIFO (First-In First-Out) module 18. Palette module 24 communicates with unpack module 46 and DMA module 14. Input FIFO 18 is used for temporary storage for data from the system AHB 12. DMA module 14 on the other hand, allows a peripheral to read and write to memory without intervention from the CPU (Central Processing Unit). DMA module 14 is also coupled to Input FIFO 18 and palette module 24. Input FIFO module 18 is coupled to unpack module 46, first multiplexor 28 and second multiplexor 38. Unpack module 46 is configured to open a file that has been compressed with data compression program, and return it to its original size.

Unpack module 46 is coupled to palette 24, which is configured to convert logical shade numbers in each pixel into physical shades. As a nonlimiting example, palette 24 may be a block of fast RAM (Random Access Memory), which is addressed by the logical shade and whose output is split into various shades which drive the actual display.

First multiplexor 28 receives inputs from input FIFO 18, palette 24 and registers 16. Multiplexor 28 is coupled to FRC module 34 and second multiplexor 38. FRC module 34 may be configured to process one pixel per internal clock cycle, and is coupled to pack module 36. Pack module 36 may be configured to collect pixels, and output those pixels all at once. Second multiplexor 38 receives inputs from registers 16, pack module 36, first multiplexor 28, and input FIFO module 18. Second multiplexor 38 is coupled to output FIFO 42, which loads data into LCD panel 48. Timing generator 44 is coupled to LCD panel 48, output FIFO 42, input FIFO 18, and registers 16.

As will be understood by one of ordinary skill in the art, FIG. 2 is merely an illustration of an LCD controller. This diagram merely shows one possible configuration and is not intended to limit the present disclosure in any way. Any number of other modules may be inserted or deleted from this diagram to produce the desired results. Similarly, any number of modules may be removed from this diagram.

FIG. 3 is a diagram illustrating a plurality of grayscale values and the corresponding time fraction to achieve a particular grayscale, similar to the diagram of FIG. 1. Table 30 of FIG. 3 differs from Table 10 in that the time base is now divided into 32 counts. By dividing the time base into 32 counts, while maintaining the 16 grayscale values, the LCD controller has the ability to account for nonlinear perception of the human eye. As stated above, the human eye perceives shades in a nonlinear fashion. This means that a shade change in a dark region is not perceived as large as a similar shade change in a lighter region. By dividing the time base over 32 counts (instead of 16) the LCD controller can stagger the deviation from one shade to another based on its relative darkness.

As a nonlimiting example, from FIG. 1, each grayscale corresponds to the number of time counts that the pixel is turned "on." Since the time base is divided into 16 parts and there are 16 grayscales, each grayscale is assigned a time part. This means that grayscale 10 is held in the "on" position for one count longer than grayscale 9. One problem may occur when the human eye cannot detect the changes in the darker grayscales, while perceiving large changes in the lighter grayscales.

FIG. 3, on the other hand, illustrates that by dividing the time base into 32 counts, the LCD programmer can assign grayscales based on the particular LCD panel and human perception. In this nonlimiting example, grayscales 0 through 2 are incremented by four counts because the human eye has difficulty perceiving small changes in this range. Grayscales 2 through 5 are incremented by three counts; grayscales 5 through 9 are incremented by two counts; and grayscales 9 through 15 are incremented by one count. This configuration is an illustration of how staggered increments can help improve clarity in an LCD panel.

As is evident to one of ordinary skill in the art, Table 30 is merely an illustration of one possible grayscale configuration. This diagram is not intended to limit this disclosure to only one grayscale configuration.

As stated above, there are three types of display problems associated with STN LCD panels: single pixel flickering, adjacent pixel flickering, and problems due to the nonlinear perception of the human eye. The nonlinear problem may be solved by using a configuration as shown in FIG. 3. However, flickering (both single pixel and adjacent pixel) may potentially still remain.

FIG. 4 is a diagram representing one embodiment of a pixel power schedule within the controller of FIG. 2, represented in binary. As shown in FIG. 4, grayscales 0-15 are present. On the right side of table 40 are listed typical power schedule corresponding to the grayscale listed to the left. As a nonlimiting example, typically in an STN LCD panel, a grayscale of 4 will have the 32 bit power schedule of logical "11110000000000000000000000000000."

This power schedule may potentially produce single pixel flicker due to the long period time when the pixel is in the "off" position (represented with logical "0"). Similarly, in the higher grayscales, the pixel is turned "on" for a large span of time, resulting in the same flickering problem.

One method of reducing flickering, may be to introduce patterns into the grayscale power schedule. Patterns may be introduced by the LCD programmer into programmable registers, which may be altered depending on the type of LCD panel, or the particular viewer of the panel.

FIG. 5 is a diagram of one embodiment of a pixel power schedule utilizing patterns to eliminate single pixel flicker in an LCD panel of FIG. 2, represented in binary. As shown in Table 50 of FIG. 5, each grayscale corresponds to the appropriate power schedule, as shown in FIG. 4. By using a pattern, such as in FIG. 5, flickering can be reduced or eliminated by allowing each pixel to change power states more often. As a nonlimiting example, grayscale 9 from FIG. 4 is turned on for the first 9 counts of the cycle. As stated above, this may result in single pixel flicker. By using grayscale 9 pattern from FIG. 5, the pixel is never held in any state (on or off) for longer than three counts. By using a pattern such as this, switching is increased, thereby reducing or eliminating single pixel flicker.

As will be appreciated by one of ordinary skill in the art, the patterns illustrated in FIG. 5 are merely nonlimiting examples, as the LCD programmer may choose any pattern for each grayscale.

FIG. 6 is a diagram of one embodiment of a pixel power schedule utilizing patterns to eliminate flicker and nonlinear effects in an LCD panel of FIG. 2, represented in binary. As shown in table 60 of FIG. 6, the patterns used are similar to those of FIG. 5. Table 60, however, utilizes all 32-bits to create patterns that correlate with the values of FIG. 3. As a nonlimiting example, from FIG. 3, grayscale 7 correlates to a time fraction of $^{21}/_{32}$. Similarly, in FIG. 6 the pattern a programmer could choose for gray scale 7 comprises 21 of the 32 counts as a logical "1." The pattern for grayscale 7 could therefore take the form:

"11101110101110101110101010101010," where the pixel is "on" for 21 of the 32 counts.

A pattern such as illustrated in FIG. 6 allows a programmer to reduce or even eliminate both single pixel flicker and nonlinear problems perceived by the human eye. This result is accomplished by first creating a new linear distribution of grayscales, and second by creating a grayscale pattern.

Figure 7:
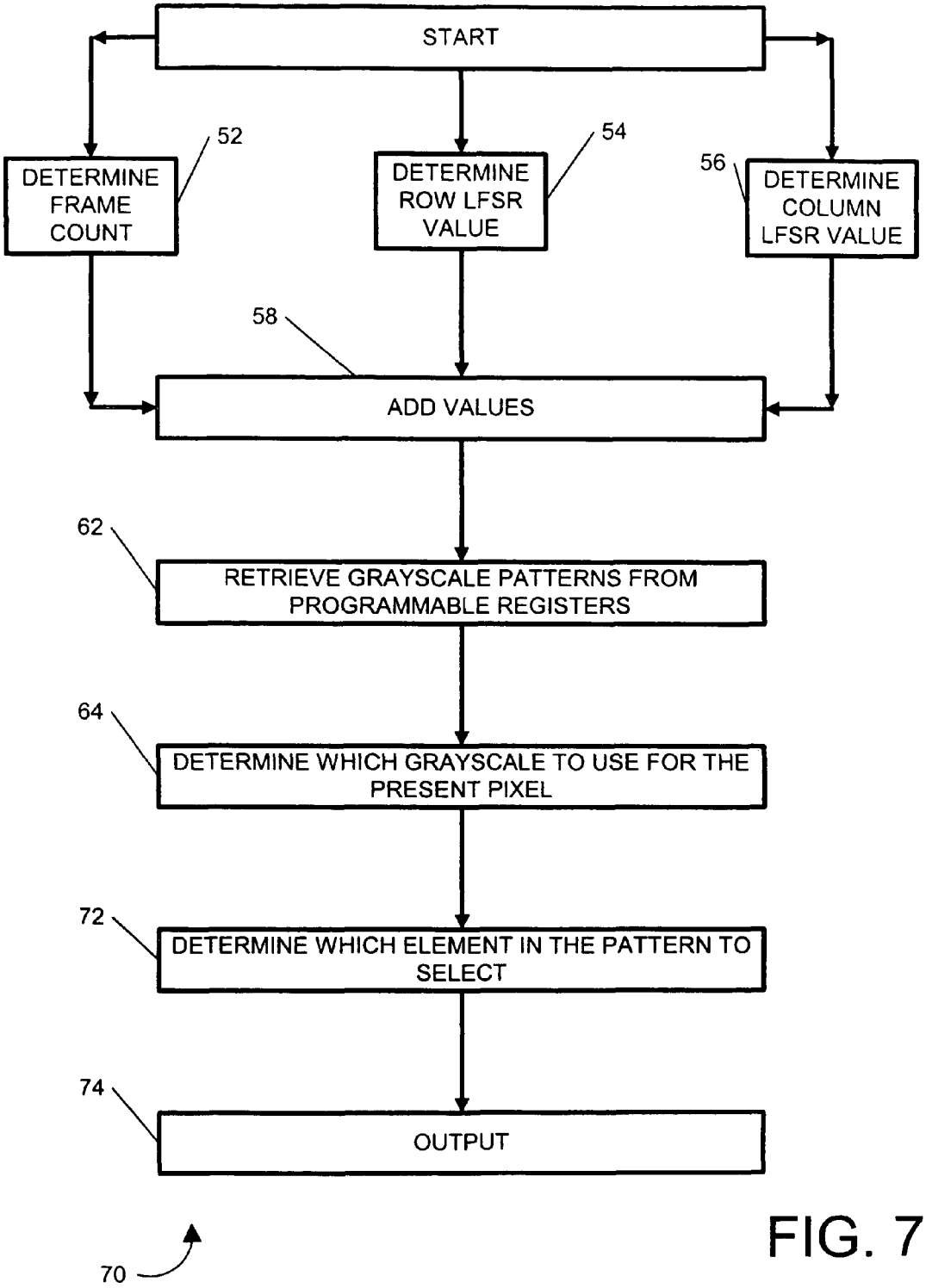
FIG. 7 is a flowchart diagram of logical steps within one embodiment of the controller from FIG. 2.

FIG. 7 is a flowchart diagram of logical steps within one embodiment of the controller from FIG. 2. As shown in flowchart 70, FRC module 34 (FIG. 2) begins by simultaneously determining frame count, determining row LFSR value, and determining column LFSR value (stages 52, 54, and 56, respectively). FRC module 34 then adds the values from blocks 52, 54, and 56, as shown in stage 58. Once the values are added, FRC module 34 retrieves grayscale patterns from programmable registers (not shown), as depicted in stage 62. Once the grayscale pattern is retrieved, FRC module 34 determines which grayscale to use for the present pixel (stage 64) and determines which element in the pattern to select (stage 72). Once these stages are complete, FRC module 34 outputs the data to the LCD panel 48.

As stated above, the row LFSR is implemented to eliminate adjacent pixel flicker along a pixel row. By randomly selecting a point in the frame count for each pixel, the pixels in that row will generally start in different states, thereby reducing or eliminating adjacent pixel flicker along that row. Similarly, the column LFSR performs the same operation along the columns of the LCD panel. By utilizing both a column LFSR and a row LFSR, adjacent pixel flicker is reduced or eliminated for the entire LCD panel.

Figure 8:
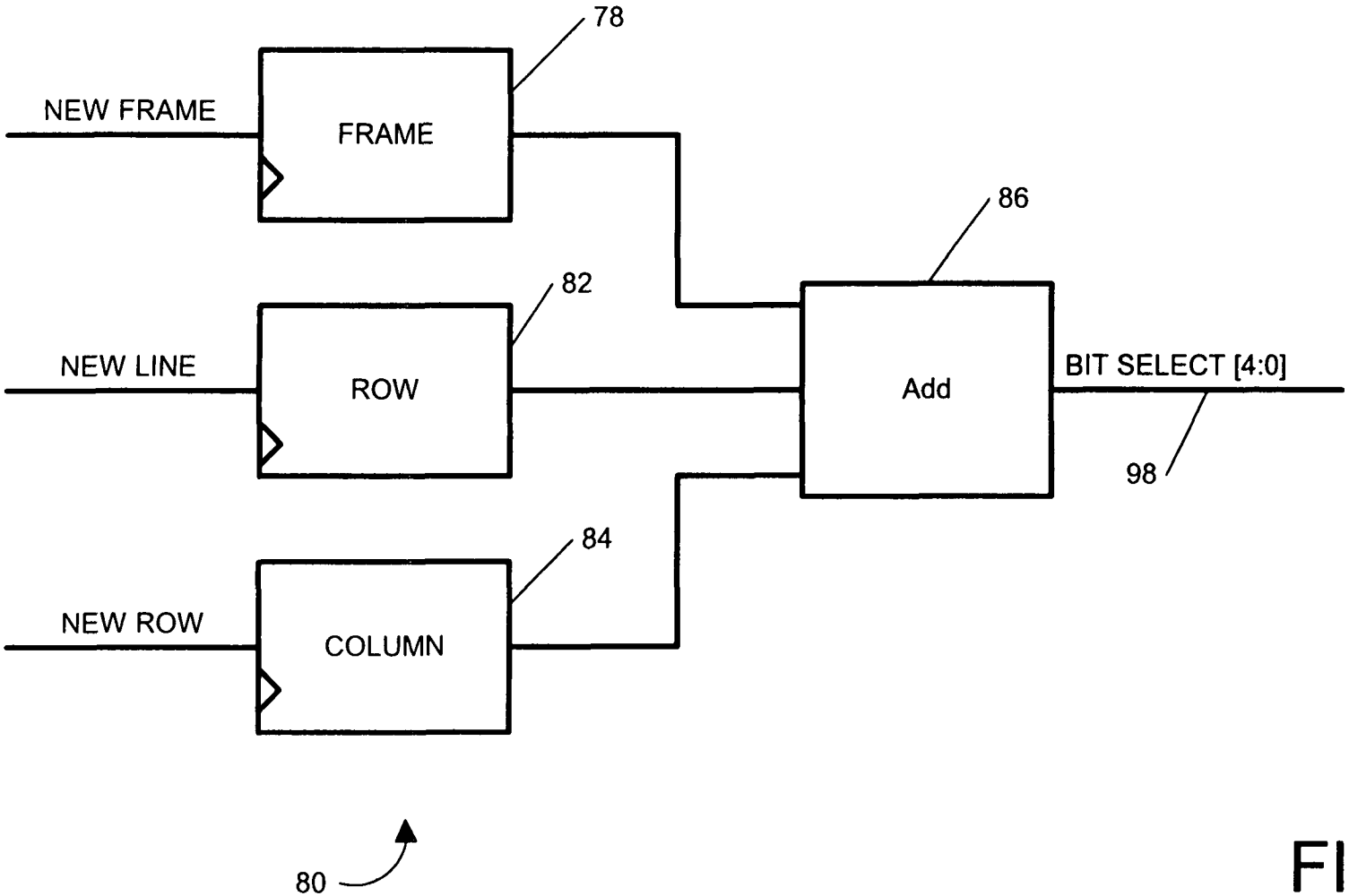
FIG. 8 is a functional block diagram of circuitry for selecting a frame pattern, located within the controller of FIG. 2.

FIG. 8 is a functional block diagram of circuitry for selecting a frame pattern, located within the controller of FIG. 2. As shown in circuit 80 of FIG. 8, frame register 78 receives and stores the present frame count. Similarly, row register 82 receives and stores the new line signal as determined from the corresponding LFSR module. Column register 84 receives and stores the new row signal from the corresponding LFSR module. Once these registers have obtained the necessary signals, they communicate this data to add module 86, which adds the data and communicates the sum (bit select signal 98) to another part of the controller circuitry.

Figure 9:
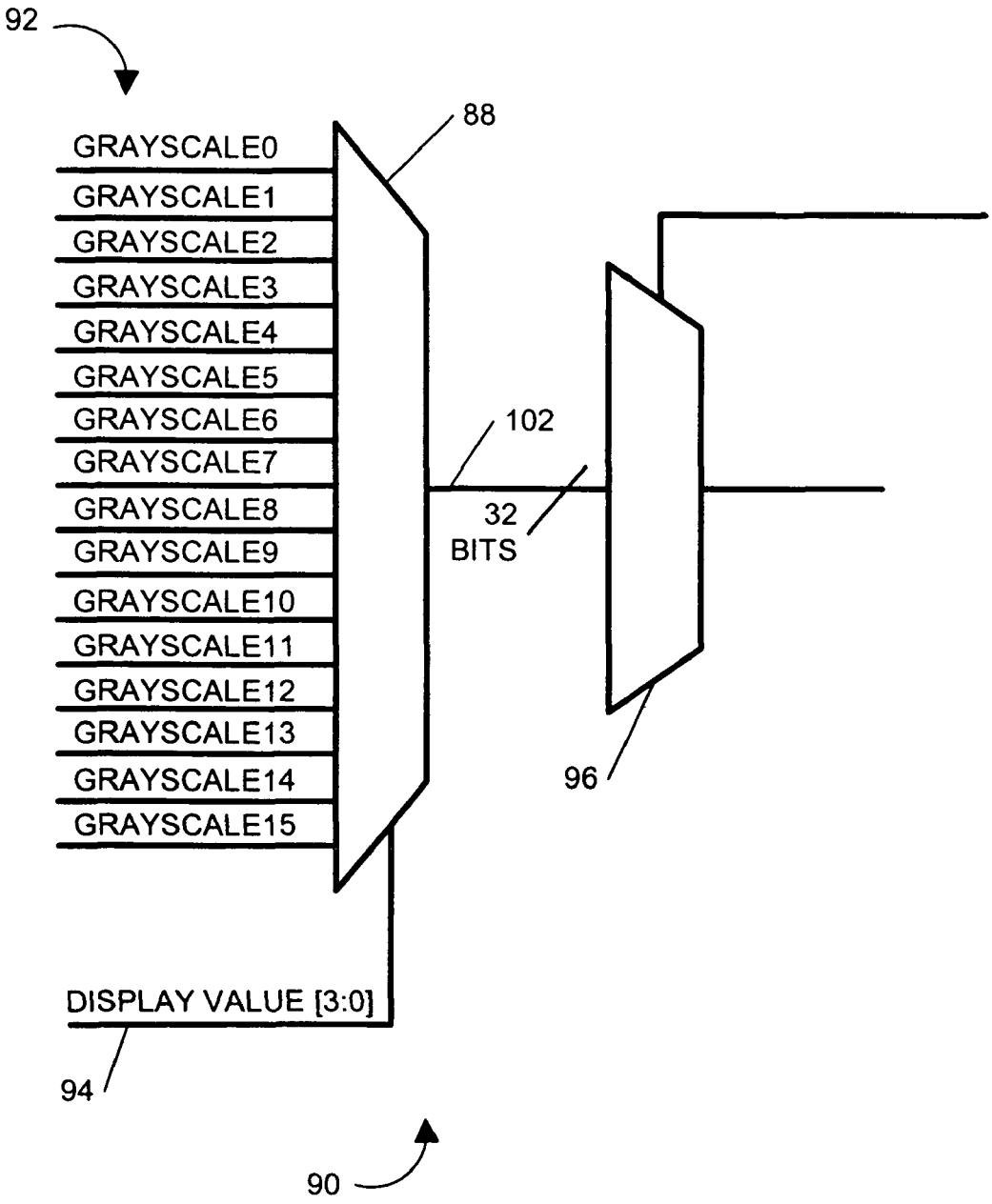
FIG. 9 is functional block diagram illustrating one embodiment of circuitry for selecting a frame pattern, located within the controller of FIG. 2.

FIG. 9 is functional block diagram illustrating one embodiment of circuitry for selecting a frame pattern, located within the controller of FIG. 2. As shown in circuit 90 of FIG. 9, first row multiplexor 88 may receive inputs 92, labeled GRAYSCALE0-GRAYSCALE15. These inputs may communicate the sixteen 32-bit grayscale values to multiplexor 88. As a nonlimiting example, if the grayscales from FIG. 6 are used, each grayscale value includes 32 bits of data. Consequentially, each input line 92 has 32 bit communication capabilities. In this example grayscale 0 is input via input line GRAYSCALE0 to multiplexor 88. Similarly, the remaining grayscales are also communicated to multiplexor 88, via GRAYSCALE1-GRAYSCALE15.

In addition, first row multiplexor 88 may also receive display value [3:0] 94, which is a signal indicating the desired grayscale for the present pixel. As a nonlimiting example, if grayscale 0 (from FIG. 6) is used for the present pixel, display value [3:0] 94 can communicate a logical "0000" to first row multiplexor 88. Communication line 102 can then communicate GRAYSCALE0 from first row multiplexor 88, via 32-bit communication line 102 into second row multiplexor 96. As illustrated in FIG. 9, communication line 102 is a 32 bit communication line, which communicates each of the 32 bits of the grayscale pattern from first row multiplexor 88 to second row multiplexor 96.

Figure 10:
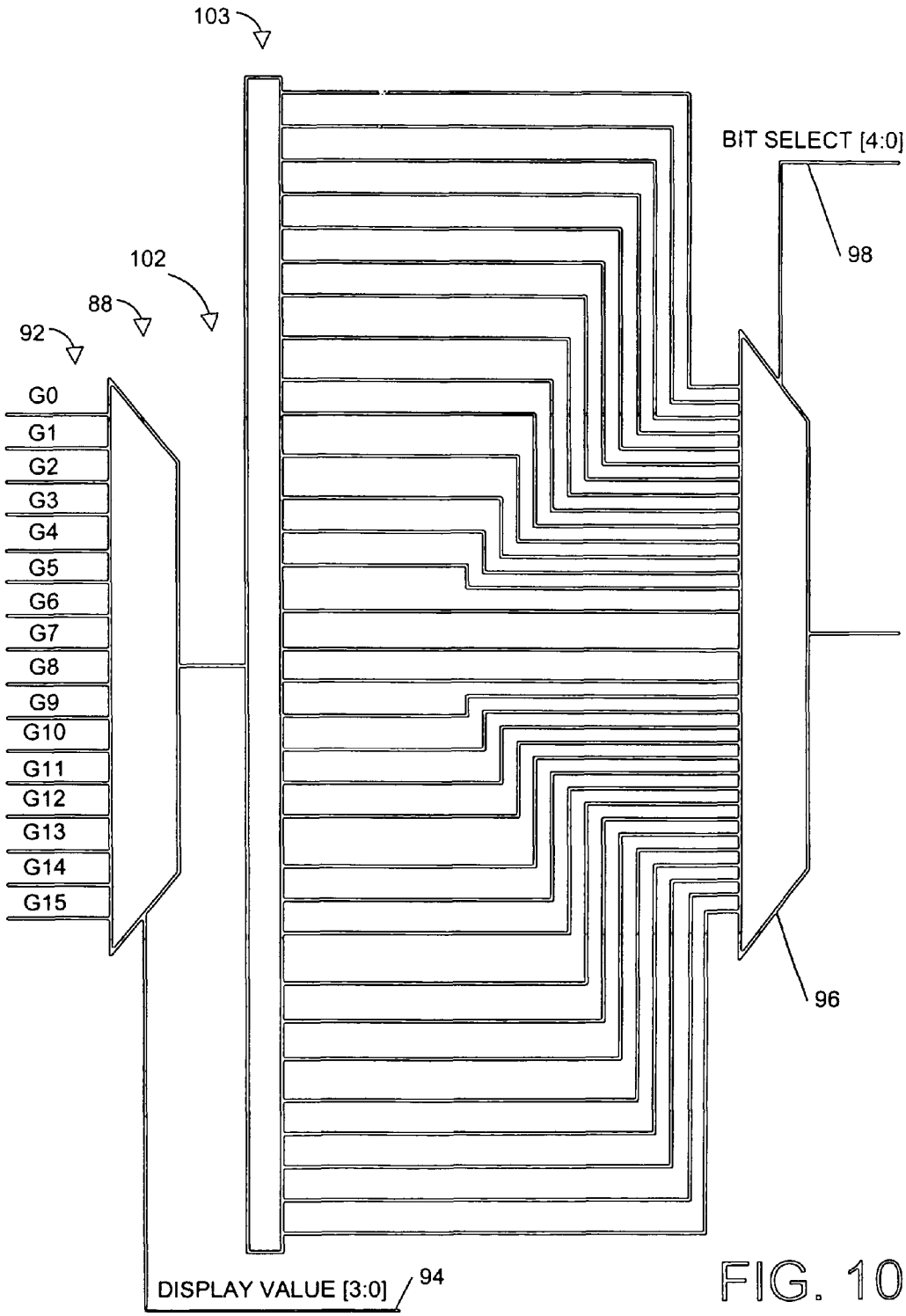
FIG. 10 is a functional block diagram of circuitry for selecting a frame pattern, located within the controller of FIG. 2.

FIG. 10 is a functional block diagram of circuitry for selecting a frame pattern, located within the controller of FIG. 2. As shown in FIG. 10, first row multiplexor 88 receives GRAYSCALE0-GRAYSCALE15 via input line 92. First row multiplexor may then select the desired grayscale, determined by display value [3:0] 94, which may be communicated to first row multiplexor 88 via the select input. When the desired grayscale is selected, first row multiplexor 88 outputs that data via 32-bit communication line 102. This bus may then be broken up into its individual bits 103 to be input into the second row multiplexor 96.

In addition, second row multiplexor 96 may be configured to select the desired bit within the selected grayscale. After the 32-bit grayscale pattern is separated into individual bits via bus 103, this data may be input into second row multiplexor 96. Bit select [4:0] 98 may then communicate the desired bit for second row multiplexor 96 to select. As a nonlimiting example, assuming that grayscale 7 from FIG. 6 is the desired grayscale and is selected via display value [3:0] 94 through first row multiplexor 88, the data pertaining to grayscale 7 may be communicated and separated by bus 103. This data (which may be represented in binary as "11101110101110101110101110101010") may then be input into second row multiplexor 96. If the desired bit of grayscale 7 is the third bit (logical bit number 2) of the grayscale, bit select [4:0] 98 may communicate a logical "00010," indicating that the third bit should pass through the output of second row multiplexor 96 (in this case a logical "0").

Figure 11:
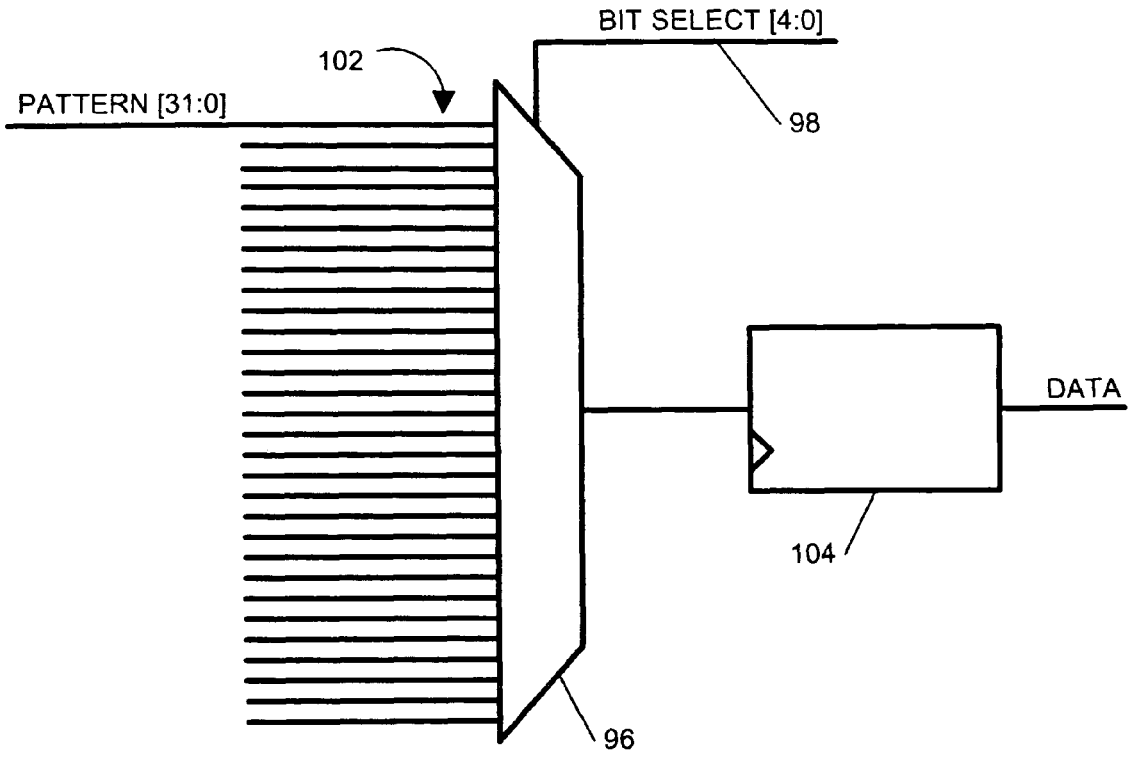
FIG. 11 is a functional block diagram of circuitry for selecting a frame pattern, located within the controller of FIG. 2.

FIG. 11 is a functional block diagram of circuitry for selecting a frame pattern, located within the controller of FIG. 2. As shown in FIG. 11, second row multiplexor 96 receives the bit pattern corresponding to the desired grayscale for the present pixel via 32-bit line 102. Second row multiplexor 96 also receives bit select signal [4:0] 98 (from FIG. 8) as its select input. This signal indicates the appropriate bit within the bit pattern, as selected by circuit 80 (from FIG. 8). This signal is a random number that, when communicated to second row multiplexor 96 selects a random starting point for each pixel. This random selection of starting points reduces or eliminates adjacent pixel flicker.

Once the appropriate bit is selected, second row multiplexor 96 communicates the appropriate signal to register 104. This register then communicates the signal to LCD panel 48 (FIG. 2).

As one of ordinary skill in the art will realize, the illustrations in the discussed figures are merely representations that help illustrate the present disclosure. These figures are not intended to limit the disclosure in any way. For example, the figures illustrate grayscale patterns with 32-bits. While this is one representation, components with different pattern lengths are also included herein. Furthermore, circuit components discussed specifically may easily be substituted for other components not discussed that are configured to perform similar operations. On a similar note, references to logical states in the discussed figures are merely nonlimiting examples of signals that may be used. As is evident to one of ordinary skill in the art, these signals may be altered to achieve similar results.

It should be emphasized that many variations and modifications may be made to the above-described embodiments. All such modifications and variations are intended to be included herein within the scope of this disclosure and protected by the following claims.

The invention claimed is:

1. A circuit for generating grayscales in a display, comprising:

a plurality of grayscale values, one of the grayscale values being a present grayscale value;

a grayscale pattern, each grayscale pattern comprising at least one pattern bit and each grayscale pattern corresponding to each of the grayscale values, wherein a pixel of the display is turned to either an on state or an off state according to the grayscale pattern such that the pixel is not in a current state more than a predetermined number of counts, the predetermined number of counts being less than a total number of counts;

a programmable register configured to store at least one grayscale pattern;

a first row multiplexer corresponding to the plurality of grayscale values, the first row multiplexer configured to receive a pattern bit from each grayscale pattern, the first row multiplexer configured to select a desired grayscale pattern, determined from the present grayscale value;

a pixel select circuit configured to determine a desired pattern bit based on a sum of the following: a frame count, a row count, and a column count, wherein the pixel select circuit includes an adder coupled to a plurality of registers, the sum indicating a starting point within the desired grayscale pattern randomly selected for a pixel; and a second row multiplexer coupled to the first row multiplexer and configured to receive a bit select signal comprising the sum and to select the desired pattern bit.

2. The circuit for generating grayscales in a display of claim 1, wherein the pixel select circuit comprises at least one register.

3. The circuit for generating grayscales in a display of claim 2, wherein at least one register is a linear feedback shift register.

4. The circuit for generating grayscales in a display of claim 1, wherein the pixel select circuit comprises a counter.

5. The circuit for generating grayscales in a display of claim 1, wherein each grayscale pattern comprises 32 pattern bits.

6. The circuit for generating grayscales in a display of claim 1, wherein each grayscale pattern is configurable by a user.

7. The circuit for generating grayscales in a display of claim 1, wherein the total number of counts comprises one of: 16 and 32.

8. The circuit for generating grayscales in a display of claim 1, wherein the predetermined number of counts is set according to a perception threshold of single pixel flicker.

9. The circuit for generating grayscales in a display of claim 1, wherein the predetermined number of counts is set according to a minimum level of switching of the pixel.

10. The circuit for generating grayscales in a display of claim 1, wherein the programmable register is configured according to a type of the display.

11. A method for generating grayscales in a display, comprising:

storing at least one grayscale pattern in at least one programmable register, each grayscale pattern comprising at least one pattern bit;

selecting grayscale pattern from one of the programmable registers, determined from a present grayscale value;

selecting at least one pattern bit for use by the display, wherein the pattern bit is a starting point within the grayscale pattern for a pixel randomly selected based on a sum of the following: a frame count, a row count, and a column count; and turning a pixel of the display to either an on state or an off state according to the grayscale pattern such that the pixel is not in a current state more than a predetermined number of counts, the predetermined number of counts being less than a total number of counts.

12. The method for generating grayscales in a display of claim 11, further comprising outputting the at least one pattern bit to a register.

13. The method for generating grayscales in claim 11, wherein the row count is determined using a linear feedback shift register.

14. The method for generating grayscales in claim 11, wherein the column count is determined using a linear feedback shift register.

15. The method for generating grayscales in a display of claim 11, wherein each grayscale pattern is configurable by a user.

16. A system for generating grayscales in a display, comprising:

a plurality of grayscale values, one of the grayscale values being a present grayscale value;

one or more grayscale patterns having a pattern bit and corresponding to the plurality of grayscale values;

one or more programmable registers configured to store a grayscale pattern;

first selector logic configured to select a grayscale pattern as determined by the present grayscale value, wherein a pixel of the display is turned to either an on state or an off state according to the grayscale pattern such that the pixel is not in a current state more than a predetermined number of counts, the predetermined number of counts being less than a total number of counts;

a bit select signal configured to indicate a present pattern bit, the present pattern bit being a starting point within the selected grayscale pattern randomly selected for a pixel, wherein the bit select signal is coupled to a bit select logic that is configured to determine the present pattern bit based on a sum of the following: a frame count, a row count, and a column count; and second selector logic configured to select the present pattern bit.

17. The system for generating grayscales in a display of claim 16, wherein the bit select logic comprises an adder logic configured to receive input from any of a plurality of registers, and output to the bit select signal.

18. The system for generating grayscales in a display of claim 17, wherein the plurality of registers comprises at least one linear feedback shift register.

19. The system for generating grayscales in a display of claim 17, wherein the bit select logic comprises a counting logic.

20. The system for generating grayscales in a display of claim 16, wherein each grayscale pattern is configurable by a user.

21. A non-transitory computer readable medium for generating grayscales in a display, comprising:

first logic storing, in a display controller, at least one grayscale pattern in at least one programmable register, the grayscale pattern comprising at least one pattern bit;

second logic selecting, in the display controller, a grayscale pattern from one of the programmable registers, determined from a grayscale value, wherein a pixel of the display is turned to either an on state or an off state according to the grayscale pattern such that the pixel is not in a current state more than a predetermined number of counts, the predetermined number of counts being less than a total number of counts; and third logic selecting, in the display controller, at least one pattern bit for use by the display, the pattern bit being a starting point within the grayscale pattern for a pixel randomly selected based on the sum of the following: a frame count, a row count, and a column count, wherein the row count is determined using a linear feedback shift register.

22. The computer readable medium of claim 21, further comprising fourth logic outputting the at least one pattern bit to a register.

23. The method of claim 21, wherein the column count is determined using a linear feedback shift register.

24. The method of claim 21, wherein each grayscale pattern is configurable by a user.

* * * * *